US006308366B1

(12) United States Patent
Hays

(10) Patent No.: US 6,308,366 B1
(45) Date of Patent: Oct. 30, 2001

(54) DRY MOP DETAILER

(76) Inventor: Patrick William Hays, 1404 Fredwill Cir., Chattanooga, TN (US) 37411

( * ) Notice: Subject to any disclaimer, the term of this patent is extended or adjusted under 35 U.S.C. 154(b) by 0 days.

(21) Appl. No.: 09/535,816

(22) Filed: Mar. 28, 2000

(51) Int. Cl.[7] ..... A47L 13/12
(52) U.S. Cl. ..... 15/115; 15/114; 15/118
(58) Field of Search ..... 15/106, 114, 115, 15/118; D32/42, 50

(56) References Cited

U.S. PATENT DOCUMENTS

| | | | | |
|---|---|---|---|---|
| 1,456,696 | * | 5/1923 | Kelly | 15/115 X |
| 1,816,529 | * | 7/1931 | Hertzberg | 15/114 X |
| 1,838,481 | * | 12/1931 | Gudka | 15/114 X |
| 2,635,272 | * | 4/1953 | Johnson | 15/118 |
| 2,671,918 | * | 3/1954 | Jones | 15/106 |
| 2,845,643 | * | 8/1958 | Provencal et al. | 15/115 X |
| 3,906,580 | * | 9/1975 | Smith et al. | 15/115 |

FOREIGN PATENT DOCUMENTS

| | | | | |
|---|---|---|---|---|
| 737140 | * | 6/1966 | (CA) | 15/115 |
| 582350 | * | 8/1933 | (DE) | 15/114 |
| 627189 | * | 9/1927 | (FR) | 15/114 |
| 1208168 | * | 9/1959 | (FR) | 15/114 |
| 480413 | * | 2/1938 | (GB) | 15/114 |
| 540103 | * | 2/1956 | (IT) | 15/114 |

* cited by examiner

*Primary Examiner*—Mark Spisich

(57) ABSTRACT

A brush attachment for use on a frame of a conventional dry mop. The brush attachment includes a clip assembly for releasably securing the brush to a portion of the mop frame with the brush also being adjustably connected to the clip assembly wherein the attack angle of the brush may be changed by the user. The brush attachment enables the user to clean both the floor surface with the dry mop as well as the baseboard and underneath display racks with the brush attachment, thus eliminating a second subsequent cleaning operation.

1 Claim, 5 Drawing Sheets

1
2

6
5
7
7
7
5
6

8
5
3
1

8
5
3
1
6

5
6

DRY MOP DETAILER

CROSS REFERENCE TO DISCLOSURE DOCUMENT

This application is related to disclosure document no. 465278.

BACKGROUND OF THE INVENTION

The present invention relates to cleaning implements for cleaning floors in commercial establishments and other buildings. The present invention can eliminate an additional cleaning step as compared to using a conventional dry mop alone. In the present invention a stiff brush is provided for attachment to a conventional dry mop for dislodging and removing debris from baseboards while the dry mop cleans the floor surface. The brush is adjustable whereby the attack angle thereof may be changed to suit the surface being cleaned. The preferred angle of attack is 70 degrees relative to the leading or front edge of the dry mop, although any angle permitted by the adjustable connection may be selected.

SUMMARY AND OBJECTS OF THE INVENTION

The object of the invention is to provide a supplemental cleaning means in the form of a stiff brush to an otherwise conventional dry mop. The present invention will simplify the cleaning of baseboards, underneath stack bases and under display racks along the isles of stores which often require a subsequent cleaning operation after the floor is cleaned. Conventional dry mops are available in may different sizes including widths of 24, 36, 48 and 60 inches and the brush of the present invention is made for attachment to any of these conventional dry mops.

DETAILED DESCRIPTION OF THE INVENTION

Figure 1:
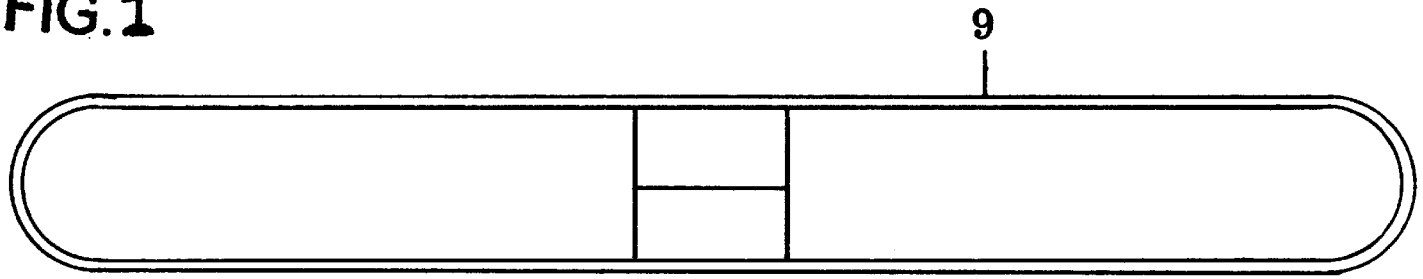
FIG. 1 is a view of standard dry mop frame.
Figure 2:
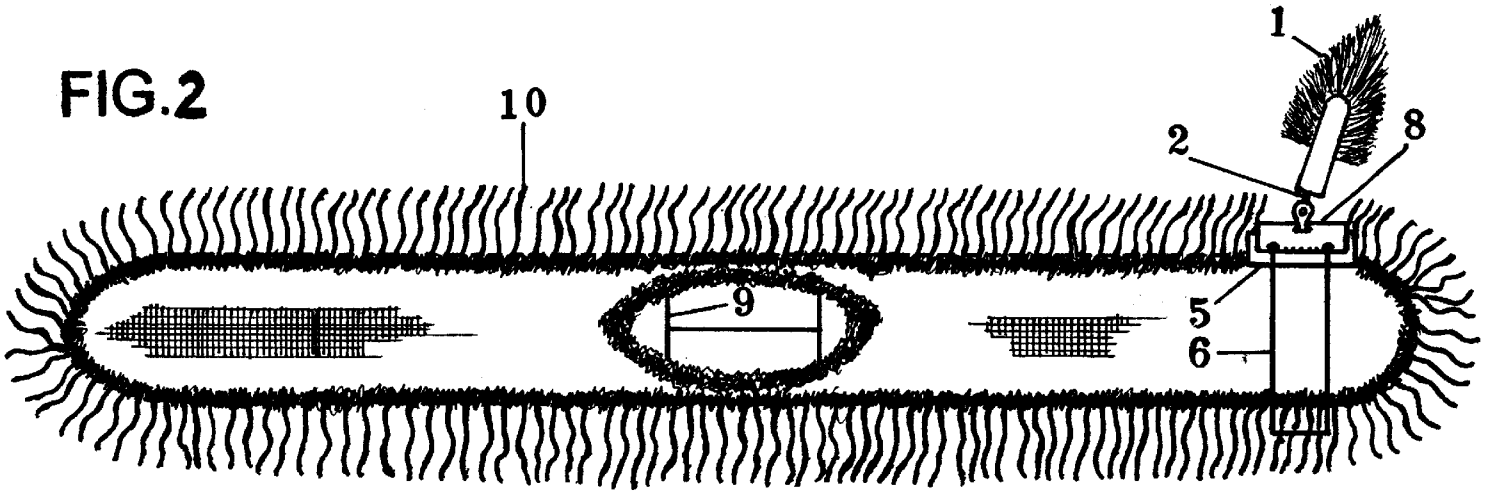
FIG. 2 is a view of the frame of FIG. 1 with a mop cover and detailer attached.
Figure 3:
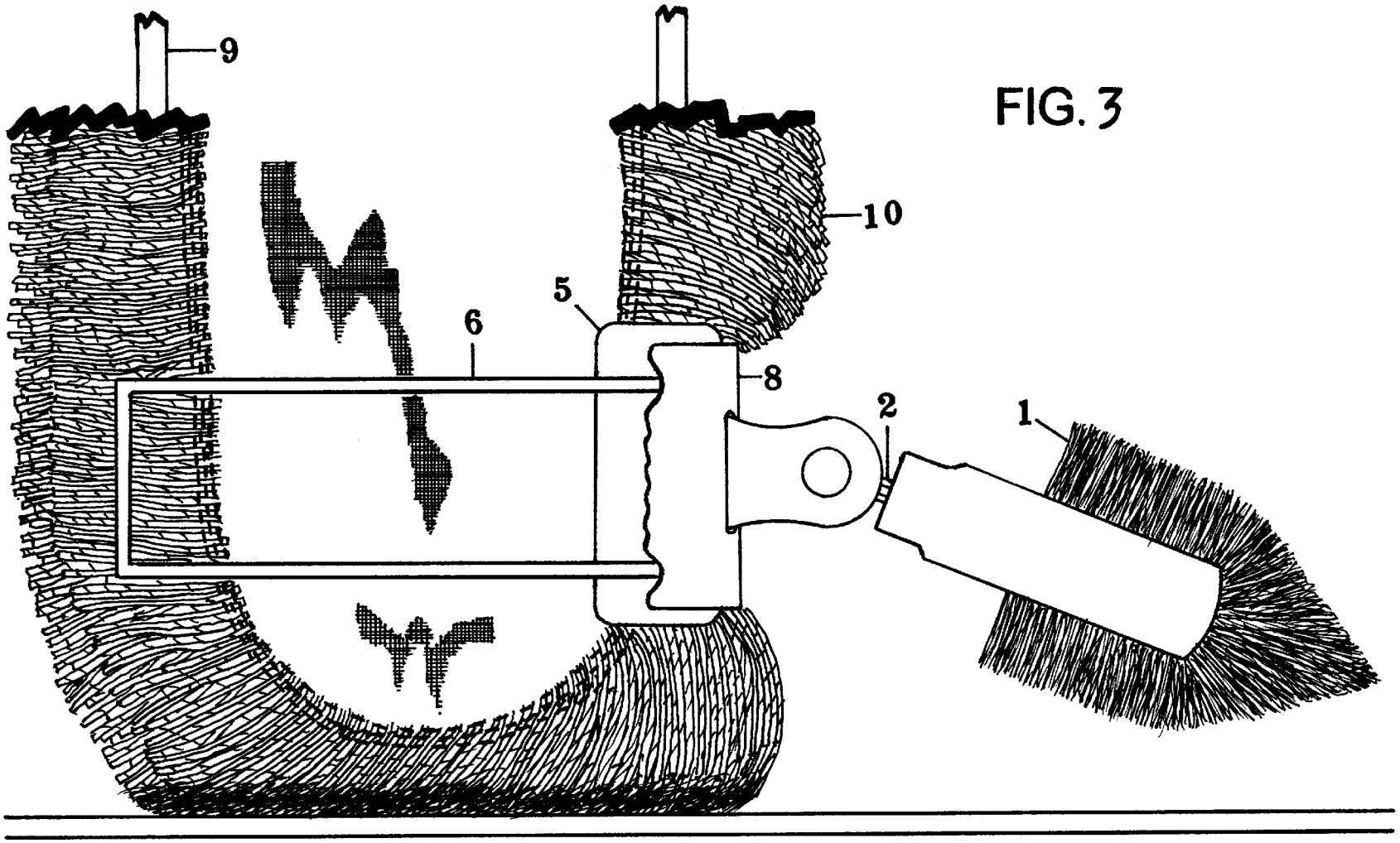
FIG. 3 is a view which illustrates the relationship of the end of the dry mop and the detailer with respect to a baseboard during cleaning.
Figure 4:
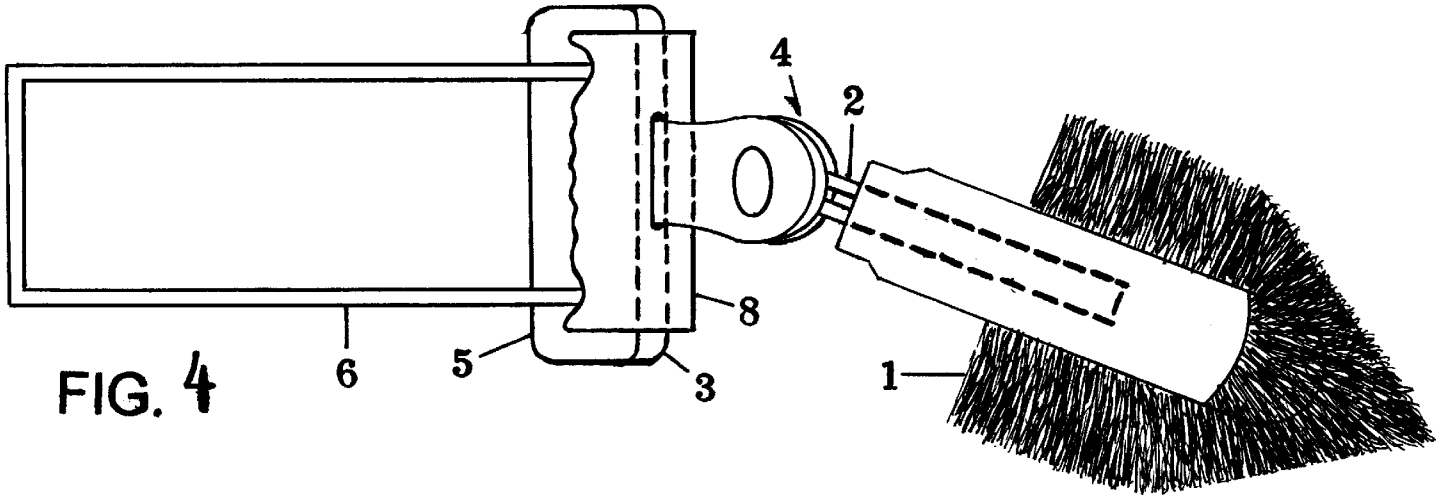
FIGS. 4 and 5 are top views of the detailer and attached clip in respective closed and open positions.
Figure 5:
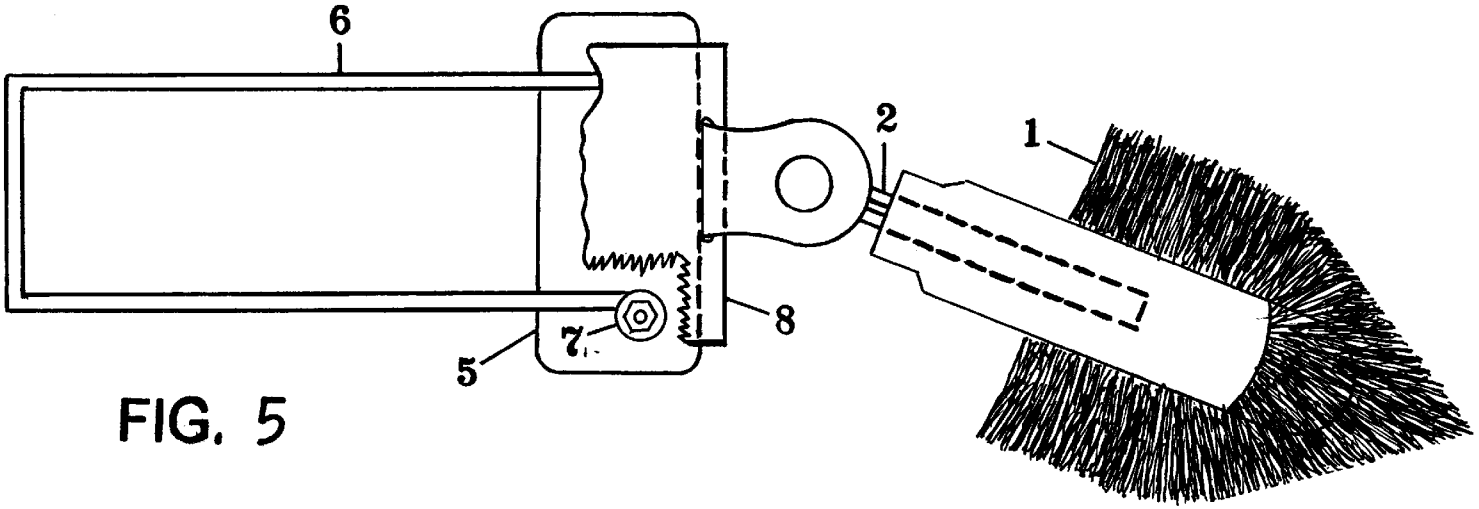
Figure 6:
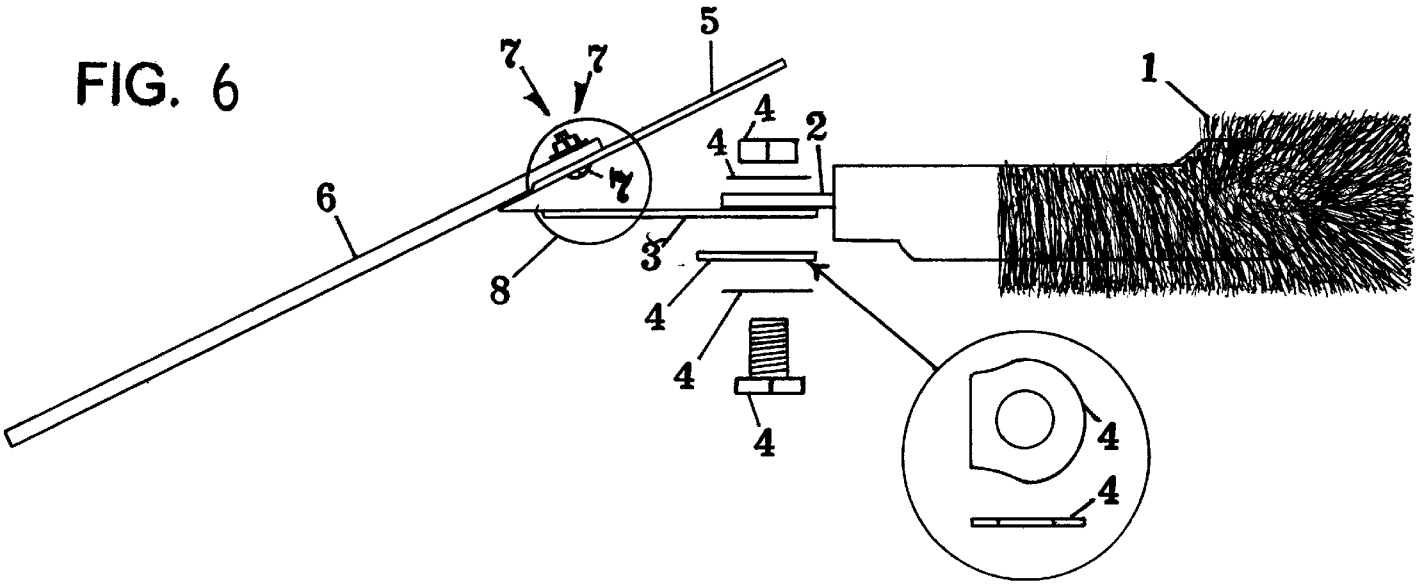
FIGS. 6 and 7 are side views of the detailer and clip in respective closed and open positions.
Figure 7:
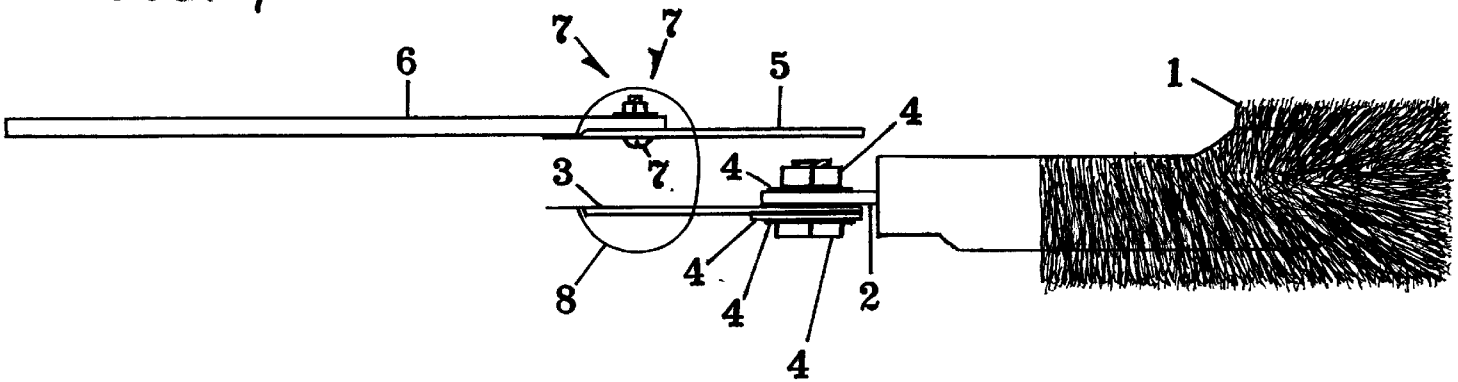
Figures 8, 9, 10, 11, 12:
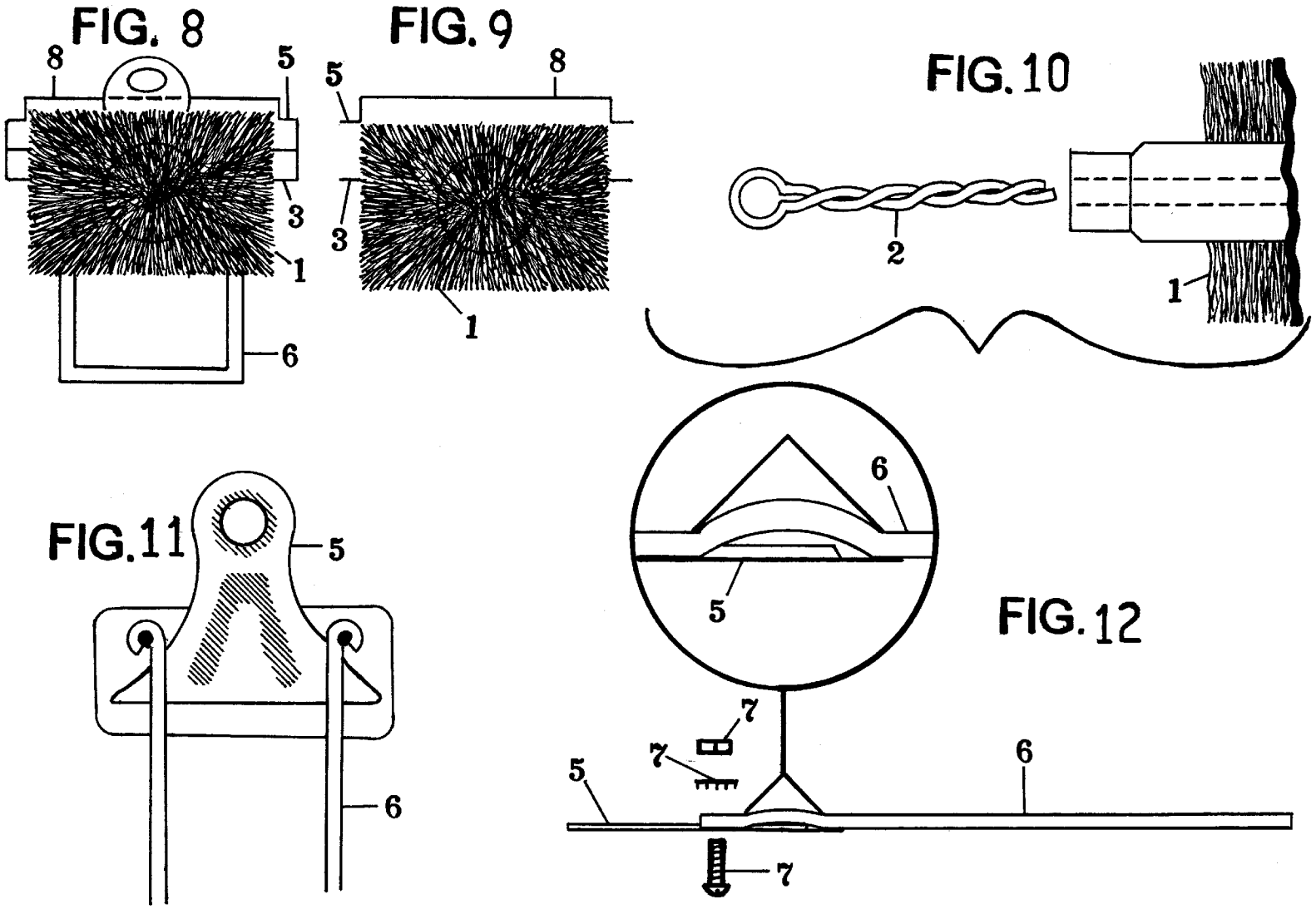
FIGS. 8 and 9 are front views of the detailer and clip is respective closed and open positions.
FIG. 10 is an exploded view showing the connection between the wire coupler and the brush head of the detailer.
FIG. 11 is a top view of the flat portion of a bulldog clip and the hold-down brace attachment.
FIG. 12 is a side view of the flat portion of the bulldog clip and the hold-down brace attachment.

FIG. 1 illustrates a frame (9) of a conventional dry mop. FIG. 2 further illustrates a mop cover (10) attached to the frame (9) in addition to the detailing brush (1) attached adjacent to the leading or front edge and right end of the mop frame (9). This brush (1) providing a means for cleaning baseboards and under display racks at the same time that the floor is being cleaned by the mop cover (10). The use of the present invention is best illustrated in FIG. 3. It is pointed out that the brush (1) could be attached to the frame at other locations along the front and rear edges. The detailing brush is comprised of a brush head having a plurality of bristles projecting therefrom. The brush head is drilled to define a bore extending into the body thereof. Into this bore is received a twisted wire member (2) (best shown in FIG. 10) having a first end received in the bore of the brush head and permanently retained therein by glue and a second end for attachment to a bulldog clip which constitutes a portion of the means for securing the brush (1) to the mop frame (9). The bulldog clip is comprised of a lower pincer (3), upper pincer (5) and a member (8) interconnecting the two pincers. As can be seen in FIGS. 2 and 3, the upper (5) and lower (3) pincers are secured about a leading edge of the frame (9). FIGS. 6 and 7 show the means (4) in the form of a bolt, washers and nut for attaching the second end of the wire member (2) to the lower pincer. The means (4) interconnecting the brush (1) and the clip permits the brush to be adjustably fixed relative to the clip (3,5,8) and the mop frame (9) so that the attack angle of the brush may be varied by the user. A brace member (6) formed of ⅛" steel rod is secured to the upper pincer (5) and rests on the upper portion of the frame (9) to help retain the brush (1) thereon (see FIGS. 2 and 3). A pair of legs at one end of the brace member are secured to the upper pincer, as best shown in FIG. 11, by respective means (7) each including a screw, washer and nut (see FIGS. 5–7 and 12). The screws thereof passing through respective holes in the upper pincer (5).

What is claimed is:

1. A floor cleaning implement comprising a) an elongated mop frame including front and rear edges and opposed right and left ends therebetween;

b) a dry mop cover which fits over said mop frame;

c) a brush extending from the front edge of the mop frame adjacent the right end thereof, said brush further comprising:

i) a clip for removably securing the brush to the mop frame;

ii) a brush body having a plurality of bristles extending therefrom; and iii) said brush body being adjustably connected to the clip at an end thereof whereby the attack angle of the brush may be changed to suit the surface being cleaned; and d) whereby the dry mop cover cleans the floor as it is moved there along and the brush is particularly adapted to clean baseboards and other areas adjacent the floor.

* * * * *